US007172091B2

(12) United States Patent
Clarke

(10) Patent No.: US 7,172,091 B2
(45) Date of Patent: Feb. 6, 2007

(54) MOP DISPENSER

(75) Inventor: George Clarke, Wilmette, IL (US)

(73) Assignee: Sweports Limited, Wilmette, IL (US)

( * ) Notice: Subject to any disclaimer, the term of this patent is extended or adjusted under 35 U.S.C. 154(b) by 67 days.

(21) Appl. No.: 10/841,373

(22) Filed: May 7, 2004

(65) Prior Publication Data

US 2005/0247723 A1 Nov. 10, 2005

(51) Int. Cl.
*B65H 3/00* (2006.01)
*B65H 1/00* (2006.01)
*A47K 10/24* (2006.01)

(52) U.S. Cl. ..... 221/44; 221/42; 221/43; 221/40; 221/46

(58) Field of Classification Search ..... 221/44
See application file for complete search history.

(56) References Cited

U.S. PATENT DOCUMENTS 4,039,181 A * 8/1977 Prewer ..... 271/10.11
5,176,237 A * 1/1993 Yang ..... 194/211
5,372,359 A * 12/1994 Miura et al. ..... 271/119

* cited by examiner

*Primary Examiner*—Gene O. Crawford
*Assistant Examiner*—Timothy Waggoner
(74) *Attorney, Agent, or Firm*—Mayer, Brown, Rowe & Maw, LLP

(57) ABSTRACT

A flat mop dispenser having a container comprising a holding pan and at least one roller proximate the pan. The roller is positioned proximate to a stack of flat mops in the pan and the roller rotates to engage a flat mop and dispense the flat mop out of the dispenser.

20 Claims, 12 Drawing Sheets

MOP DISPENSER

FIELD OF INVENTION

This invention relates generally to cleaning apparatuses, and more particularly to a dispenser for dispensing mops.

BACKGROUND OF INVENTION

When in use, traditional string mops can quickly become contaminated, thus necessitating frequent mop head cleaning in a bleach or other strong disinfectant. This is especially true with commercial applications, such as hospitals, where the useful cycle life of a clean mop head is dictated by regulations, which aim to reduce that amount of contamination that can be spread from hospital room to hospital room. Moreover, hospital regulations also require that the cleaning solution used for the string mop be changed in regular intervals, again to reduce the possibility of spreading bacteria or viruses among rooms and patients. This changing of the mop head and mop cleaning solution is a labor intensive process, thereby increasing the labor demands of an institution and raising costs. Moreover, these processes waste significant amounts of water and toxic chemicals and lead to environmental concerns due to the amount of toxic chemicals that are placed into public and private sewage systems, which may ultimately find their way into lakes, streams, reservoirs, etc.

Flat mops are an improvement over string mops, in that a solution containing the required cleaning agent(s) can be stored in a container having a multitude of clean flat mops. These flat mops are typically rolled into a cylindrical shape and placed side by side in the container. When a new flat mop is required a user can grab a clean flat mop from the container and replace the existing mop. Under this approach, a dirty flat mop never has to come into contact with clean solution. However, even with this method, the user still needs to physically grab a flat mop out of the solution and place it on the floor, which can increase the possibility that dirt, viruses or bacteria on the user's hands (or gloves) can infect the clean solution, as well as the remaining flat mops in the solution. Moreover, it is inconvenient for a user to have to reach into a container having cleaning solution and remove a flat mop, which requires the user to subsequently wash and dry his or her hands. If a user does not wear gloves when reaching into the cleaning solution, adverse skin reactions can occur, which could lead to missed work, disabilities, worker's compensation claims against an employer and the need for an employer to hire temporary workers. Thus, there is a need for an improved method and apparatus for changing flat mops to obviate the aforementioned disadvantages. Other needs will become apparent upon a further reading of the following detailed description taken in conjunction with the drawings.

SUMMARY OF THE INVENTION

One embodiment of the invention comprises a flat mop dispenser having a container comprising a holding pan and at least one roller proximate the pan. The roller is positioned proximate to a stack of flat mops in the holding pan and the roller rotates to engage a flat mop and dispense the flat mop out of the dispenser.

DETAILED DESCRIPTION OF THE PREFERRED EMBODIMENT

Figure 1:
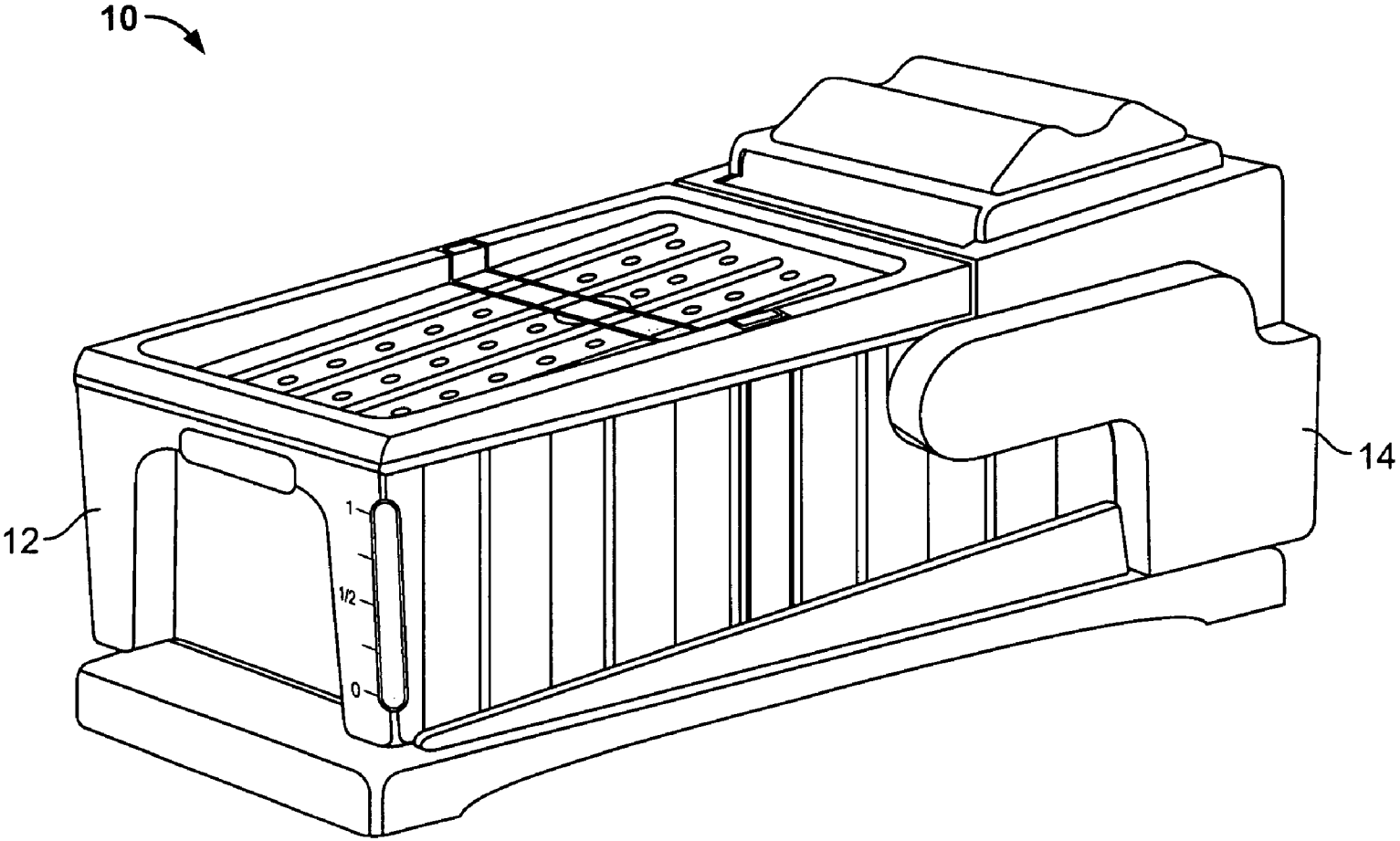
FIG. 1 is a perspective view of one embodiment of the mop dispenser of the present invention.

While the present invention is capable of embodiment in various forms, there is shown in the drawings and will be hereinafter described a presently preferred embodiment with the understanding that the present disclosure is to be considered as an exemplification of the invention, and is not intended to limit the invention to the specific embodiment illustrated.

Figure 2:
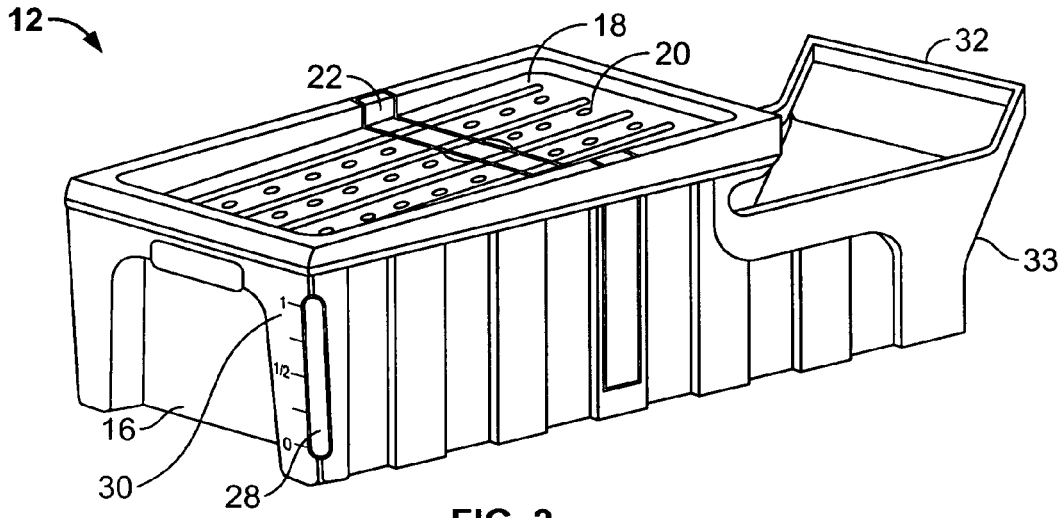
FIG. 2 is a perspective view of a holding pan for use with one embodiment of the mop dispenser of the present invention.

As shown in FIG. 1, one embodiment of the mop dispenser of the present invention, designated generally as reference numeral 10, contains a holding pan section 12 and a roller section 14. As shown in FIG. 2, holding pan section 12 contains a substantially rectangular housing 16, which contains a top section 18 with drain apertures 20, which are used to drain any excess mop fluid from a mop that is dispensed onto the top section 18. To improve the draining function of the drain apertures 20, the top section is preferably tilted downward approximately 15 degrees. However, it will be understood that top section 18 need not be tilted downward and that holding pan 12 need not contain a top section 18 or drain apertures 20. Indeed, the mop dispenser of the present invention need not be used with wet mops at all. Instead, a dry mop can be dispensed from the dispenser 10.

Figure 3:
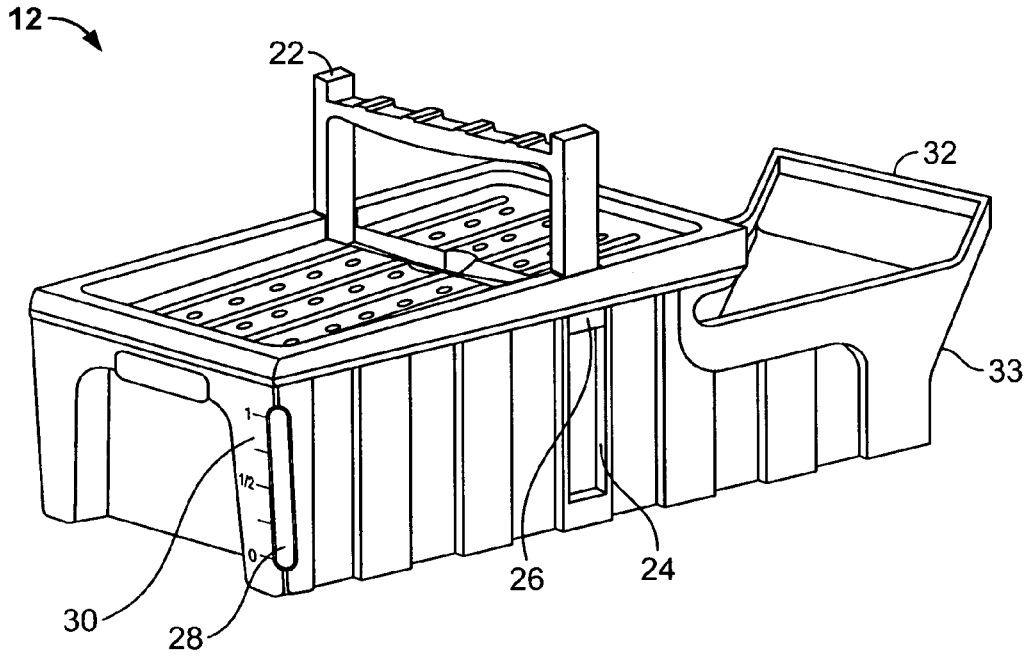
FIG. 3 is a perspective view of a holding pan for use with one embodiment of the mop dispenser of the present invention with a handle thereon in an extended position.

It is preferred that the holding pan section 12 also contains a carrying handle 22, that can be extended and retracted within guides 24 on either side of the holding pan section 12. FIG. 2 shows the handle in a retracted position and FIG. 3 shows the handle in an extended position. Stops 26 are provided on each side of the handle 22 to prevent the handle from being completely removed from the holding pan section 12. Moreover, it is preferred that holding pan section 12 contains a cleaning solution level window 28, preferably made out of clear plastic. The cleaning solution level window 28 allows a user of the mop dispenser 10 to determine the level of cleaning solution using indicia 30, which are preferably injection-molded into the holding pan section 12.

Holding pan section 12 also preferably contains an angled end section 32, which is used to help lock the holding pan section into the roller section 14. Also, holding pan section 12 contains a contoured front section 33, which is intended to abut a contoured section of roller section 14 when the holding pan section 12 and roller section 14 are combined.

Figure 4:
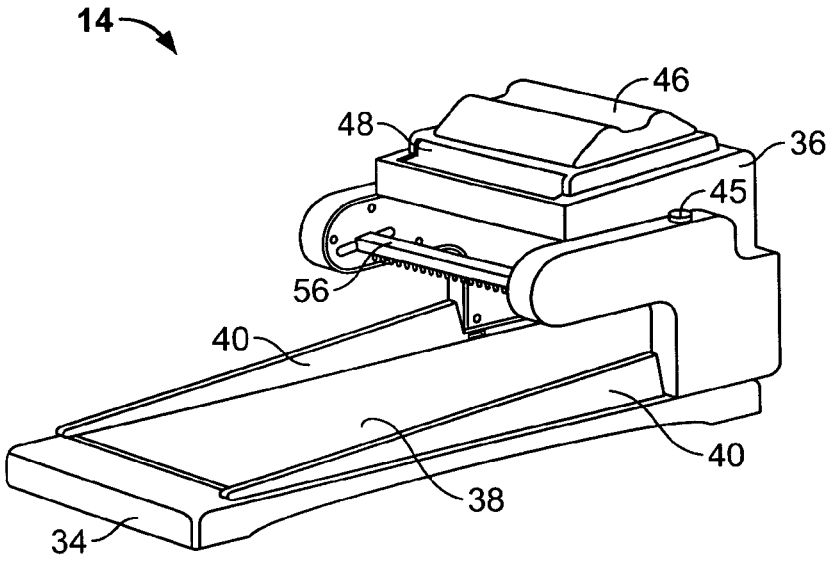
FIG. 4 is perspective view of a roller section for use with one embodiment of the mop dispenser of the present invention.
Figure 5:
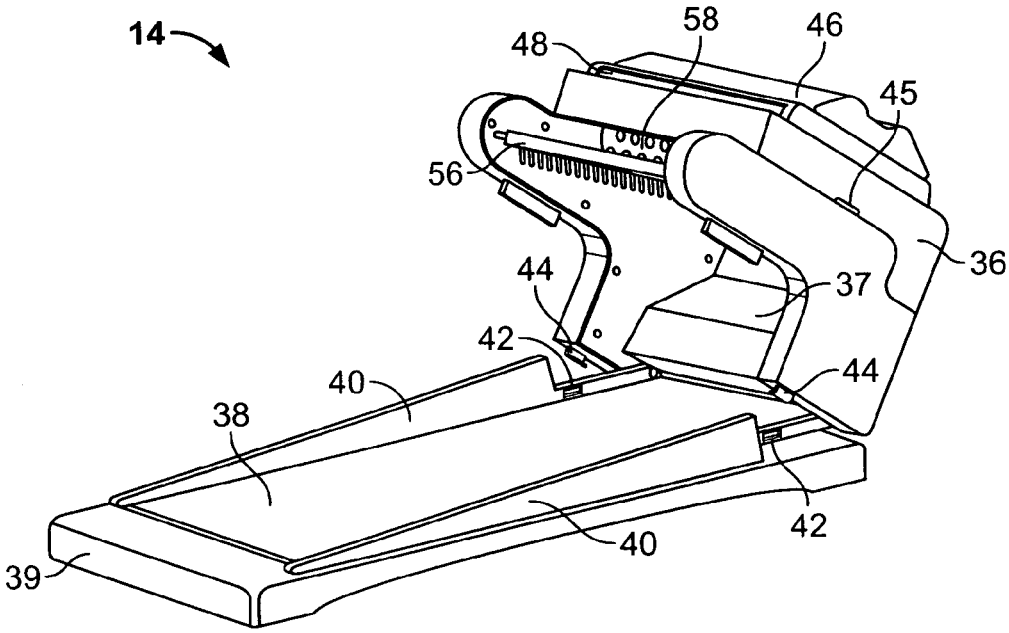
FIG. 5 is a perspective view of a roller section for use with one embodiment of the mop dispenser of the present invention with a head section thereof in an open position.
Figure 6:
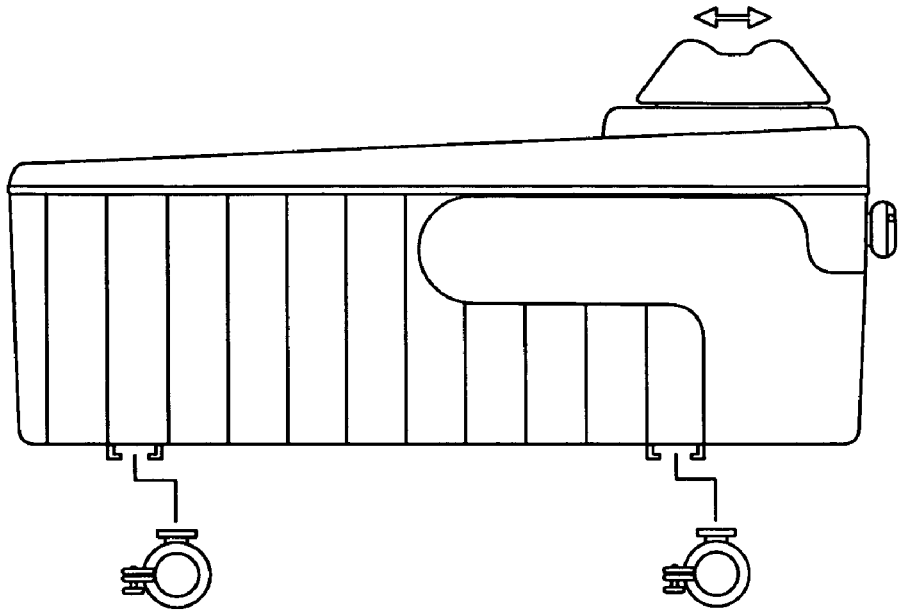
FIG. 6 is a side view of one embodiment of the mop dispenser of the present invention.

FIG. 4 shows a perspective view of the roller section 14. Roller section 14 contains two main parts: a base section 34 and a pivoting head section 36. Base section 34 is generally rectangular and contains a hollow middle portion 38, which is designed to accept the holding pan 12 between wall sections 40. The base section also includes locking apertures 42 (FIG. 5), which are designed to accept locking tabs 44 on the pivoting head portion 36. A release button 45 releases the locking tabs 44 from locking apertures 42 when, for example, a user desires to change the holding pan 12 for a holding pan 12 of a different size.

Figure 10:
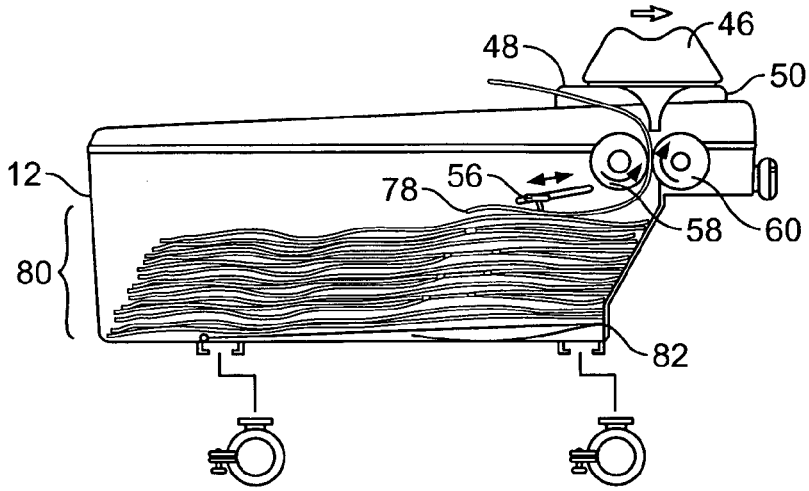
FIG. 10 is a cross-sectional view of one embodiment of the mop dispenser of the present invention.
Figure 11:
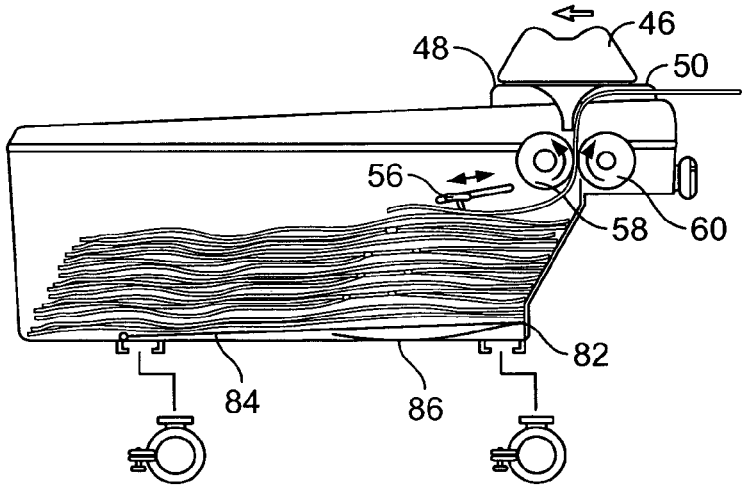
FIG. 11 is a cross-sectional view of one embodiment of the mop dispenser of the present invention showing a mop being dispensed toward a floor.
Figure 12:
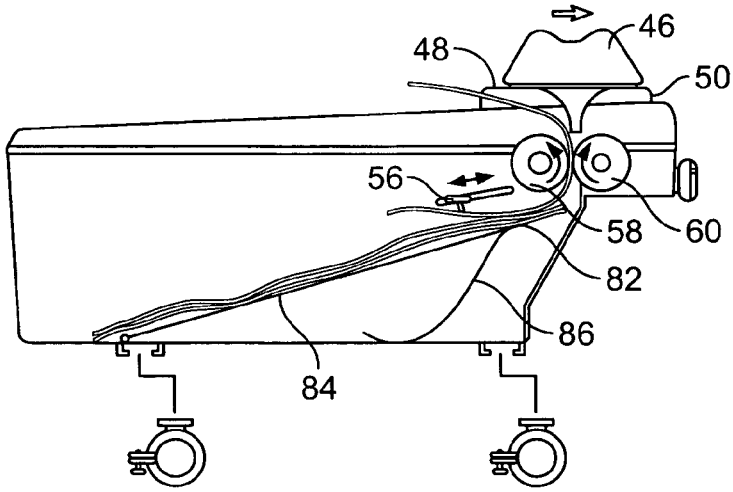
FIG. 12 is a cross-sectional view of one embodiment of the mop dispenser of the present invention showing a mop being dispensed toward the top of the holding pan.
Figure 13:
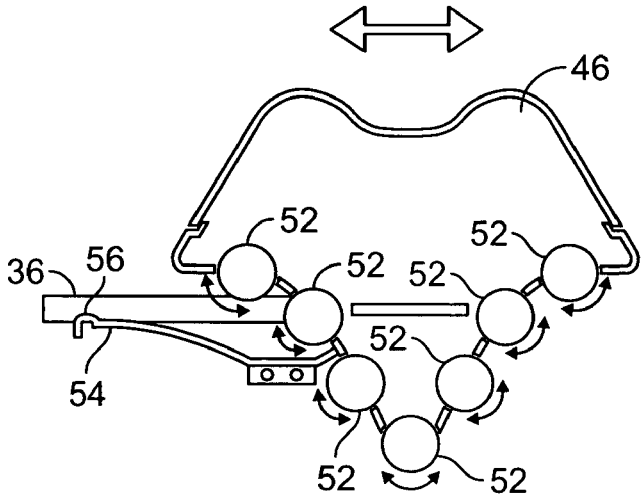
FIG. 13 is a cross-sectional view of a diverting member used for one embodiment of the present invention.

The pivoting head section 36 includes a sliding diverting member 46, which allows a mop to be selectively dispensed on either the top of the holding pan 12 through dispensing aperture 48, or directly onto a floor through dispensing aperture 50 (FIGS. 10–12). As shown in more detail in FIG. 13, the sliding diverting member 46 contains a plurality of rollers 52, which facilitate the movement of a mop while being dispensed. The diverting member also includes a spring locking member 54, which acts to keep the diverting member 46 in a particular position by engaging a recess 56 in the top portion of pivoting head section 36. As those with skill in the art will appreciate, multiple recesses 56 can be provided in pivoting head section 36 to provide for a multitude of positions. In a preferred embodiment, however, two recesses are preferred, which correspond to a mop being dispensed either onto the top of holding pan 12 or onto a floor.

Figure 7:
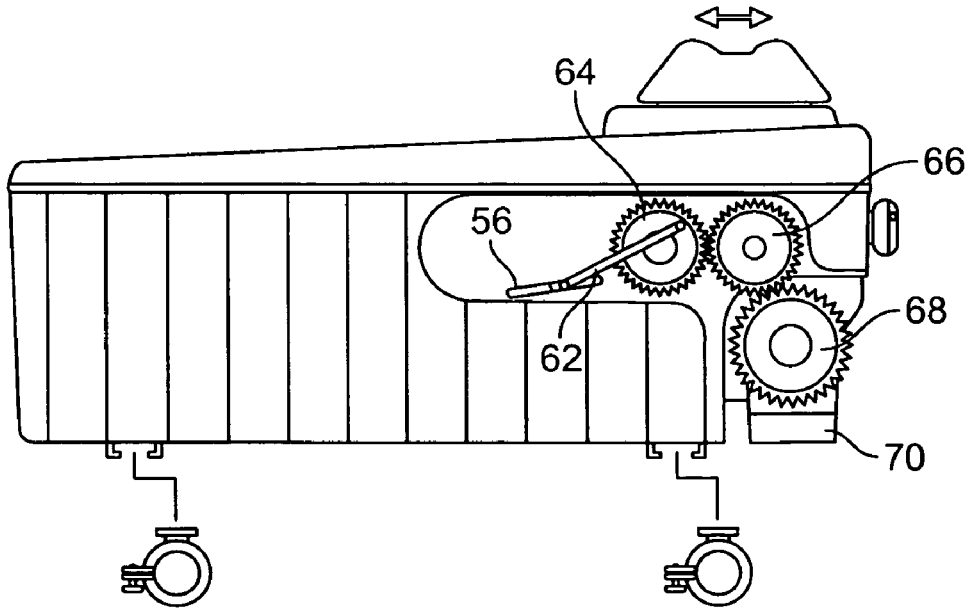
FIG. 7 is a side view of one embodiment of the mop dispenser of the present invention with a gear cover thereon removed.

The pivoting head section 36 also includes a reciprocating pick-up bar 56, which acts to draw a mop from the holding pan 12 into rollers 58 and 60 (See, e.g., FIGS. 10–12). The reciprocating pick-up bar 56 is driven via a rod 62 (FIG. 7) that is attached to gear 64. Gear 64 is, in turn, driven by gear 66, which is, in turn, driven by gear 68, which is connected to a prime mover. Gear 64 is connected to roller 58 and gear 66 is connected to roller 60. In a preferred embodiment, the prime mover is a direct current electric motor 70. However, it should be appreciated that the prime mover can comprise any other device that can turn a shaft, such as a simple hand crank or a device used to store potential energy (for instance in a coiled spring), wherein a user can wind the coiled spring (i.e., using a hand crank) at the beginning of a work day, and release the energy stored in the spring in intervals when a new mop is desired. Alternatively, the prime mover can be energized by a simple movement of a foot or hand pedal 72 (FIG. 9) each time a user desires to dispense a new mop. It is also within the scope of the present invention that more than one prime mover can be used. For instance, separate prime movers can be attached to each of the two rollers 58 and 60.

Figure 8:
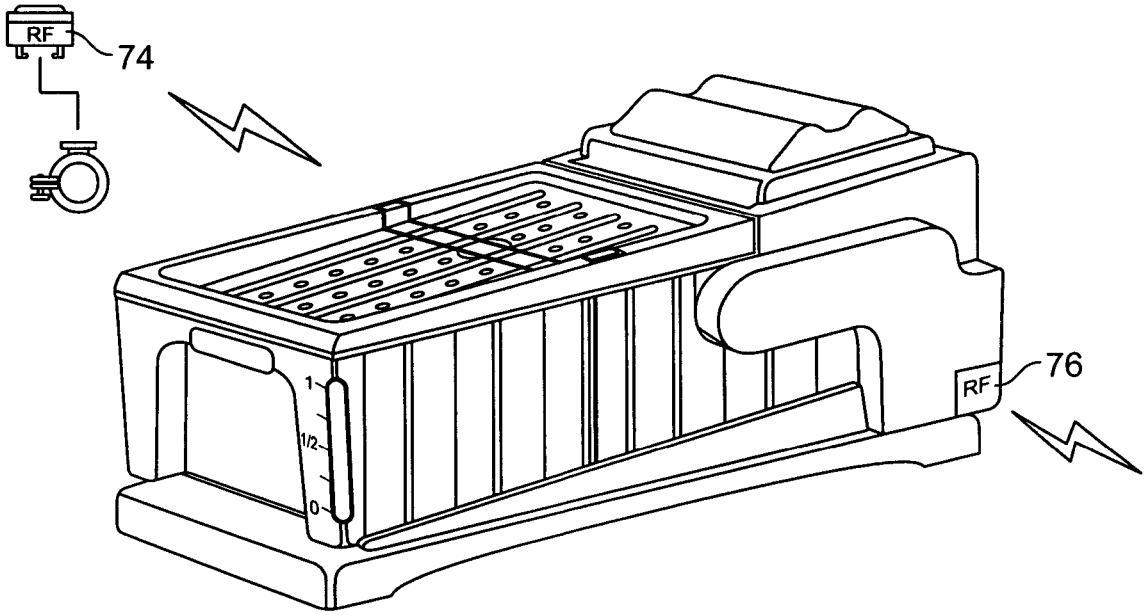
FIG. 8 is perspective view of one embodiment of the mop dispenser of the present invention that is battery operated.
Figure 9:
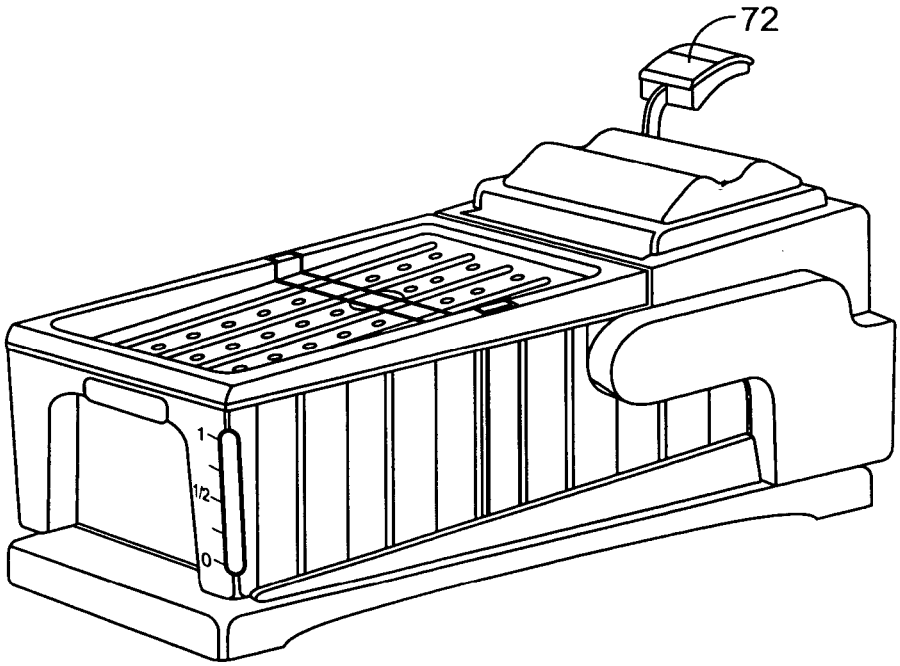
FIG. 9 is a perspective view of one embodiment of the mop dispenser of the present invention that is manually operated.

In the embodiment using a direct current electric motor, it is preferred that the motor comprise a 12–18 volt motor coupled to a rechargeable battery, depending on the particular application, of the type commonly found on portable electric tools, such as portable electric drills. However, those with skill in the art will recognize that any type of electric motor with sufficient torque can be used with the current invention. Also, other power sources such as alternating current and solar power sources can be used. In the embodiment of the present invention using a direct current electric motor, it is preferred that the motor be actuated using a remote control transmitter 74 using RF technology, as shown in FIGS. 8 and 9. Thus, a user can keep a remote RF transmitter 74 in a convenient location, such as the top of a mop cart, and actuate the transmitter when a new mop is desired. The transmitter 74 will then communicate with a RF receiver 76 on the mop dispenser, which will actuate the motor to dispense a mop.

FIGS. 10–12 show a mop dispensing operation of one embodiment of the present invention. As shown in FIG. 10, if a user desires to dispense a flat mop 78 from a stack of mops 80 in the holding pan 12, a user will first move the diverting member 46 to the rear of the mop dispenser and then actuate, in one embodiment, the electric motor 70. This will cause the reciprocating bar 56 to reciprocate and move the mop to be dispensed 78 toward roller 58 which is connected to gear 64. The mop 78 will then proceed through rollers 58 and 60 and, due to the position of diverter 46, will be dispensed through dispensing aperture 48 and onto the top of holding pan 12. Alternatively, a user may decide that he or she wishes to dispense a mop directly onto a floor. In this case, the user will move the diverter 46 to the front of the mop dispenser and then actuate, in one embodiment, the electric motor 70. This will cause the reciprocating bar 56 to reciprocate and move the mop to be dispensed 78 toward roller 58 which is connected to gear 64. The mop 78 will then proceed through rollers 58 and 60 and, due to the position of diverter 46, will be dispensed through dispensing aperture 50 and onto the floor. It should be noted that while a preferred embodiment of the present invention utilizes a reciprocating bar to facility a mop coming into contact with a roller, the present invention can be used without a reciprocating bar.

As those with skill in the art will appreciate, because the flat mops typically connect to a mop frame using a hook and loop fastening system or other suitable attachment method, a user of the dispenser 10 will want the hook and loop system side of the flat mop to be facing up to facilitate the attachment of the mop frame to the flat mop and to avoid the user having to touch the flat mop to flip it over or to align the hook and loop fastening system. Accordingly, when a user desires for a mop to be dispensed onto a floor, the flat mops will preferably be loaded into the holding pan 12 with their hook and loop system side facing up. This hook and loop system-side up orientation will be maintained as the mop is ejected out of exit port 50, as shown in FIG. 11. On the other hand, if a user desires a flat mop to be dispensed onto the top of the holding pan 12, the flat mops will preferably be loaded into the holding pan 12 with their hook and loop system side facing down, as the mops will be flipped over, and become hook and loop-side up, by the time they are ejected out of exit port 48 due to the action of roller 58 and diverter 46, as shown in FIG. 12.

As can be seen in FIGS. 10–12, the stack of mops 80 is biased in an upward direction by resilient member 82, which in a preferred embodiment comprises a pivoting ramp 84 and a spring member 86. It is to be appreciated, however, that any type of biasing structure will work with the present invention. For example, resilient member 82 can be replaced with floatation devices, opposing magnets, foam, rubber, etc. Alternatively, mops 80 can be manufactured so that they are buoyant in a cleaning solution, therefore removing the need for the resilient member 82 or other biasing structure all together.

Figure 14:
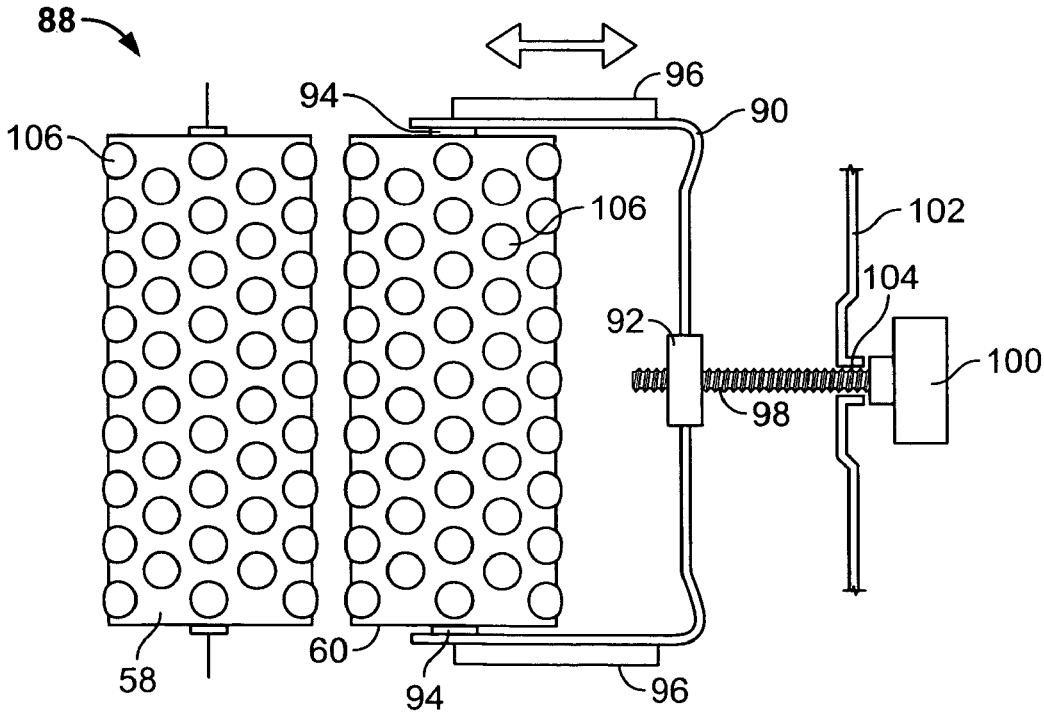
FIG. 14 is a top view of an adjustable wringer assembly used with one embodiment of the present invention.

FIG. 14 shows a wringer assembly 88 for use with one embodiment of the present invention. The wringer assembly 88 comprises a U-shaped bracket 90 that contains a threaded portion 92 and roller mounting extensions 94, to which roller 60 is rotatably attached. The U-shaped bracket is slideably connected to mounting portions 96 preferably via a pin and slot configuration (not shown). However, those with skill in the art will recognize that any other structure for slidably mounting U-Shaped bracket 90 to mounting portions 96 is acceptable in the practice of one embodiment of the present invention. The wringer assembly 88 includes a threaded bolt 98, which is threaded into threaded portion 92 on one end and is connected to an adjusting knob 100 on the other end. The adjusting knob 100 is located on the outside of the rear housing 102 of pivoting head section 36. Accordingly, in order for the adjusting knob to connect to the threaded bolt 98, the threaded bolt passes through aperture 104 in the rear housing 102. The distance between roller 60 and roller 58 determines the pressure exerted by these rollers on a mop to be dispensed, and therefore determines how much cleaning solution is wrung from the mop as it passes through rollers 58 and 60. Thus, if a user desires a dryer mop, he or she will turn the adjusting knob 100 counterclockwise to bring the rollers 58 and 60 closer together. Alternatively, if a user desires a wetter mop, he or she will turn the adjusting knob clockwise to provide more separation between rollers 58 and 60. It should be appreciated that while the embodiment shown in FIG. 14 provides for a movable roller 60 and a stationary roller 58, other embodiments could be used with the practice of the present invention wherein both rollers are movable, or roller 58, as opposed to roller 60 is movable. FIG. 14 also shows that rollers 58 and 60 preferably contain knobby projections 106, which aid the rollers 58 and 60 in picking up and wringing a mop. However, it will be appreciated that such projections, as well as adjustable rollers, are not necessary for the practice of the present invention.

Figure 15:
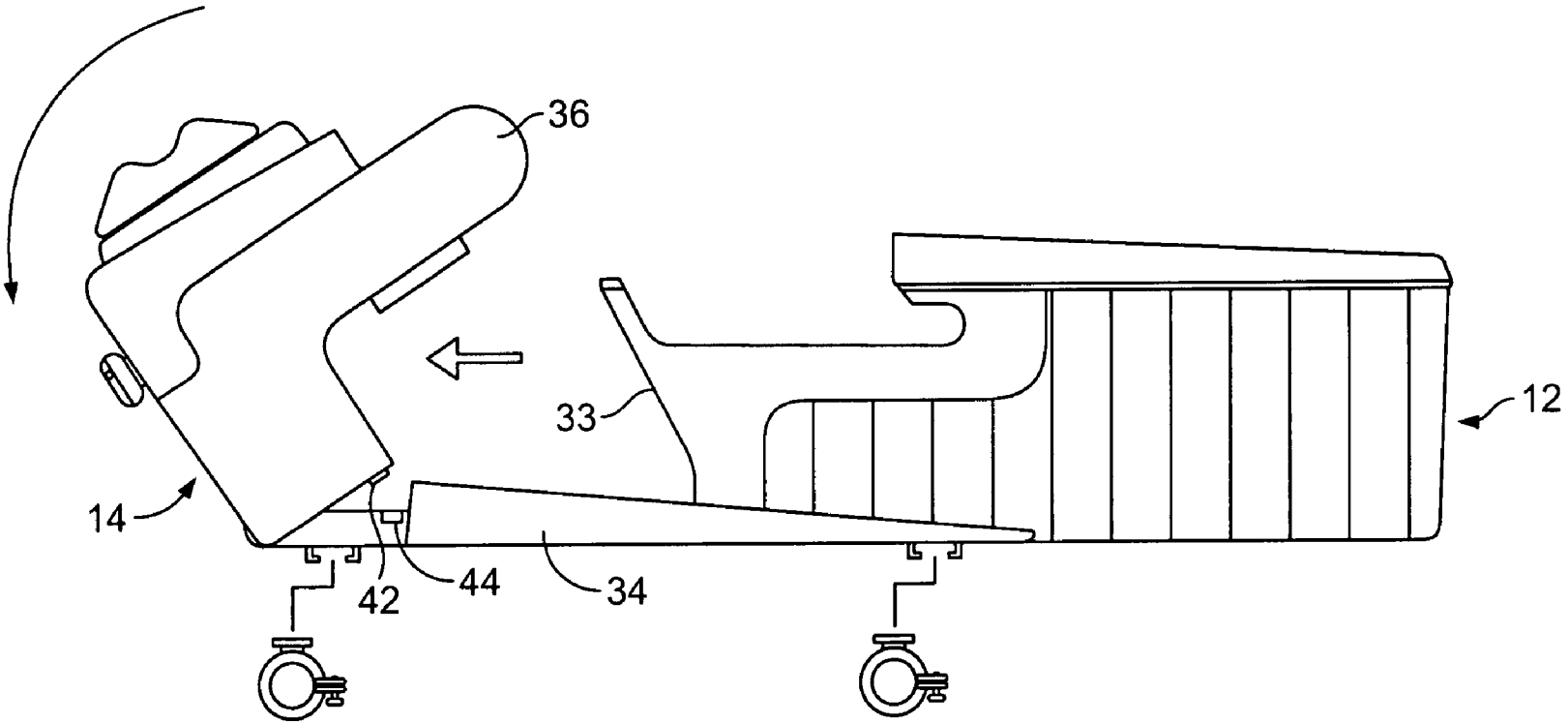
FIG. 15 shows a step for assembling the holding pan to the roller section in one embodiment of the present invention.
Figure 16:
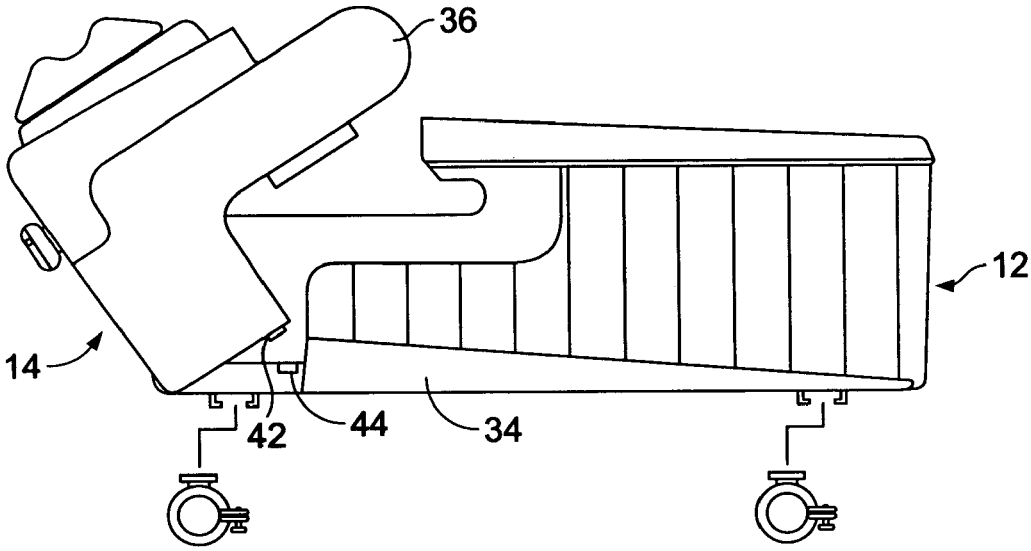
FIG. 16 shows another step for assembling the holding pan to the roller section in one embodiment of the present invention.
Figure 17:
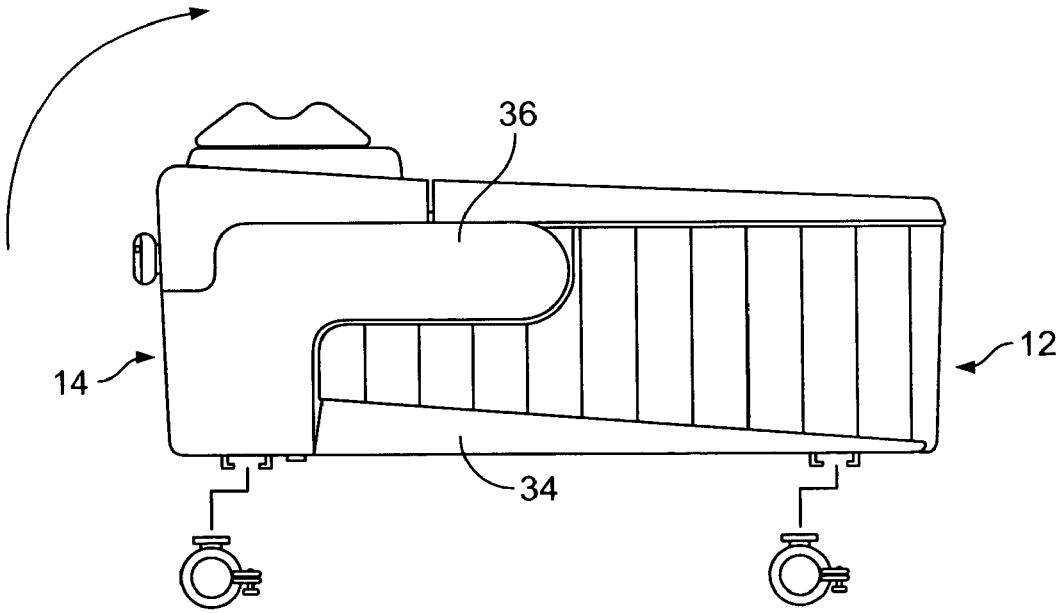
FIG. 17 shows another step for assembling the holding pan to the roller section in one embodiment of the present invention.

FIGS. 15–17 show a method, in one embodiment of the invention, for inserting the holding pan section 12 into the roller section 14. As shown in FIG. 15, a user will first release and pivot the pivoting head section 36 of roller section 14 to the position shown in FIG. 15. Next, a user will slide the holding pan section 12 into the roller section 14 until the holding pan section 12 cannot move any further in that direction (as shown in FIG. 16), which is the point in which contoured back section 37 (FIG. 5) of pivoting head section 36 abuts the contoured front section 33 (FIG. 3) of holding pan 12. Finally, the pivoting head section 36 is pivoted downward in the direction shown in FIG. 17 so as to lock the pivoting head section 36 to base section 34 via locking tabs 44 and locking apertures 42. This action also locks the holding pan section in the roller section 14, so as to form a unitary mop dispenser 10.

Figure 18:
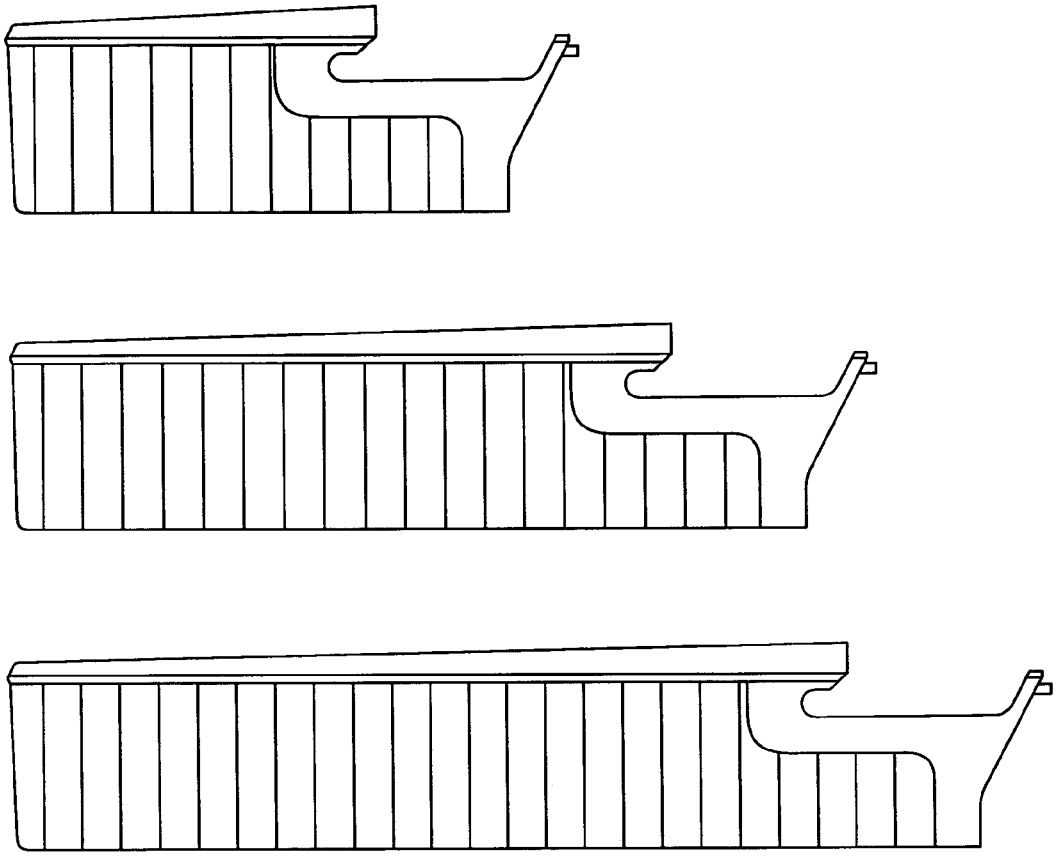
FIG. 18 is a side view showing various sizes of holding pans for one embodiment of the present invention.

The holding pan section 12 of one embodiment of the present invention can advantageously come in different sizes, so as to accommodate different mop sizes. For instance, a user can have a different holding pan section 12 for 15 inch, 20 inch and 26 inch mops, which each holding pan section having a similar structure so that they can be incorporated into roller section 14 without any modification thereto. Different sized holding pan sections 12 are shown in FIG. 18. It will be appreciated, however, that in the alternative to having different holding pans of different sizes, a single holding pan could be used with removable partition walls. Also, it is within the scope of the present invention that a large holding pan could be used for all sizes of mops and not have any partitions or other means for changing the size of the section of the pan where the mops sit. However, it is preferred that different sized holding pans or a pan with a partition wall(s) be used so that a user can conserve resources by not having to fill the holding pan with more cleaning solution than is necessary for a given mop size.

Figure 19:
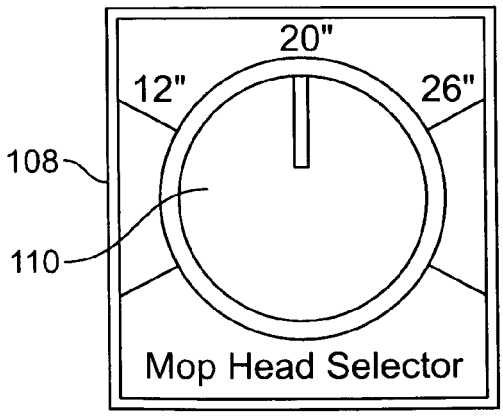
FIG. 19 shows a mop size selector switch for use with one embodiment of the present invention.

Because of the different holding pan 12 sizes (and, accordingly, different mop sizes) that roller section 14 can accommodate, the amount of revolutions of the rollers 58 and 60 will preferably change depending on the size of the mop to be dispensed. In one embodiment of the invention, the mop dispenser will include a mop selector 108, as shown in FIG. 19, that displays the various mop sizes and contains a rotatable selector switch 110 that a user rotates to select the mop size being used. This selection by a user will change the amount of revolutions completed by rollers 58 and 60 when a user actuates the motor. Thus, a larger mop size selection will result in a greater number of revolutions being performed by the rollers 58 and 60 and a smaller mop size selection will result in a lesser number of revolutions being performed by the rollers 58 and 60. It should be understood that while mop sizes of 15, 20 and 26 inches are shown as indicia on the rotatable selector switch, any size mop can be used in the practice of the present invention.

Figure 20:
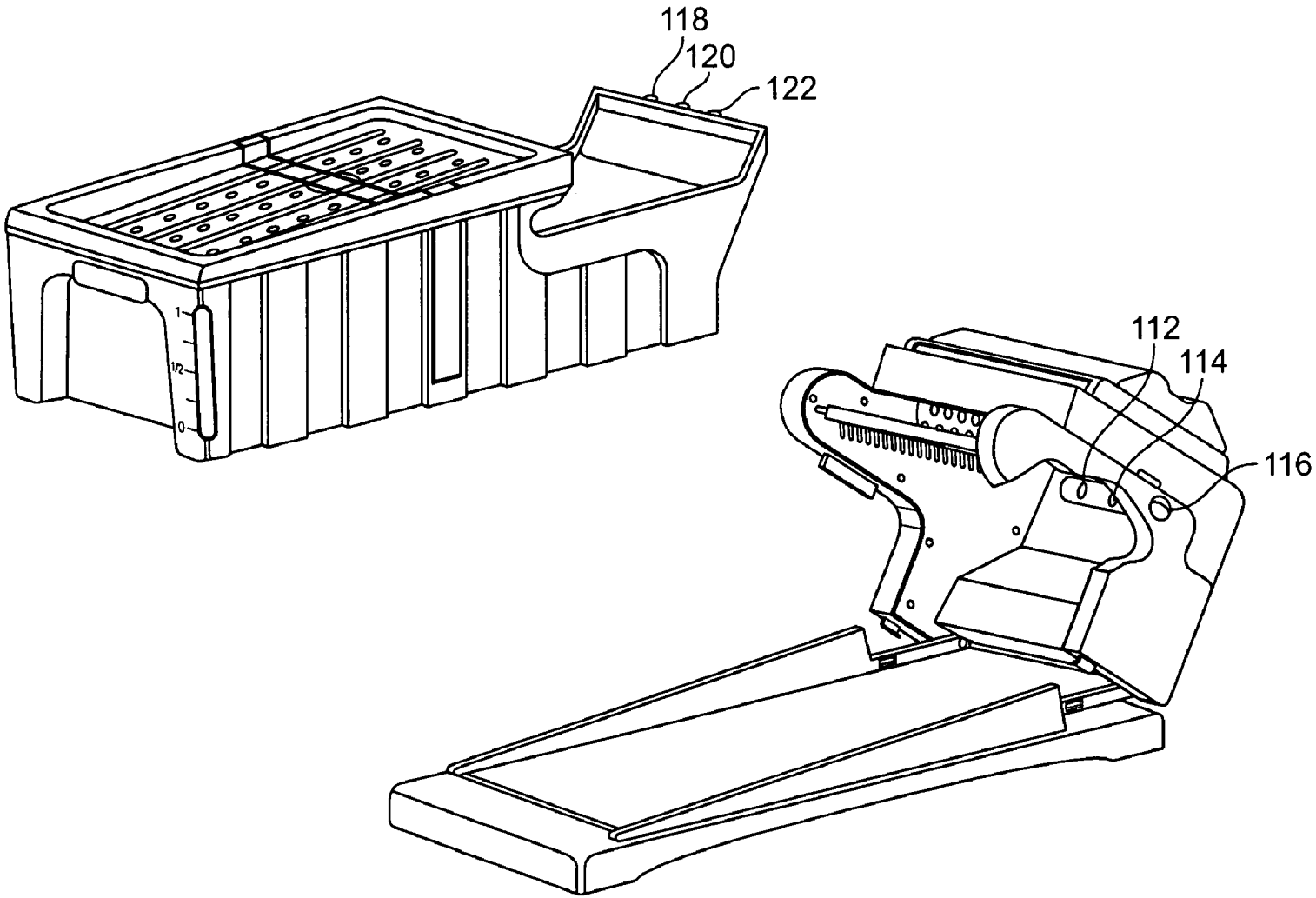
FIG. 20 is a perspective view of one embodiment of the mop dispenser of the present invention having an automatic mop size detector arrangement.

Another embodiment of the present invention includes an automatic holding pan size detection scheme that obviates the need for a manual selector. As shown in FIG. 20, one such automatic detection scheme employs three switches 112, 114 and 116 located within the pivoting head section 36 of roller section 14. In a preferred embodiment, one of these switches will be actuated depending on the size of the holding pan 12 inserted into roller section 14. For instance, if a 12" holding pan is inserted, a projection 118 on the angled section 32 will trigger switch 112. Alternatively, if a 20" holding pan is inserted, a projection 120, which is in a different position than projection 118, will trigger switch 114. Likewise, if a 26" holding pan is inserted, a projection 122, which is in a different position than projections 118 and 120 will trigger switch 116. It will be appreciated that any number of switches and/or projections can be used with the present invention. Also, other detection schemes besides a projection and switch scheme can be used with the present invention. For instance, optical switches or magnetic switches can be used instead of the projections 118, 120 and 122 and the mechanical switches 112, 114 and 116.

Figure 21:
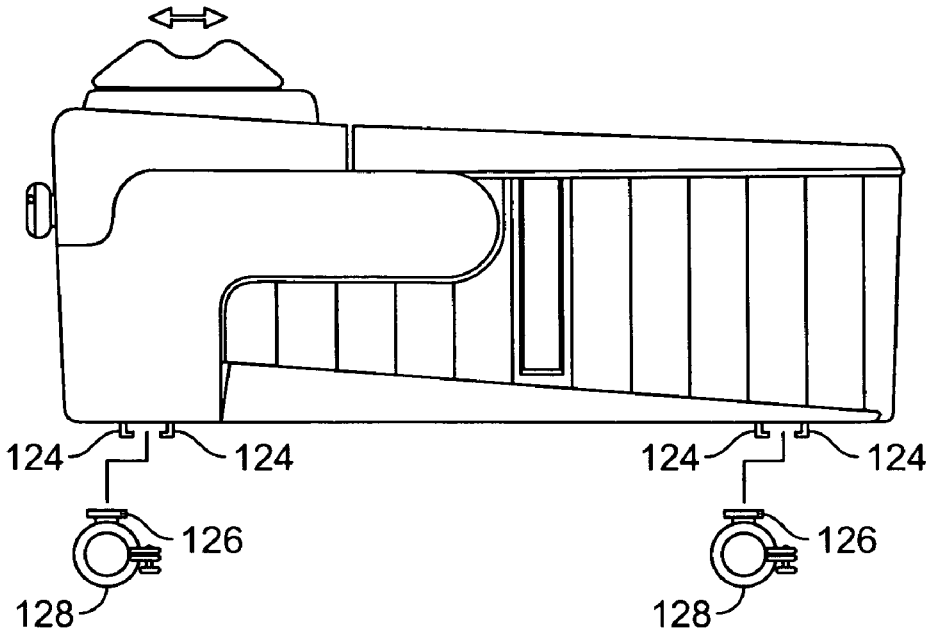
FIG. 21 is a side view of one embodiment of the present invention showing a universal mount arrangement thereon.

FIG. 21 shows a structure for mounting the mop dispenser 10 in one embodiment of the present invention. In this embodiment, the mop dispenser 10 includes brackets 124 that can slide onto T-Shaped projections 126 that are fixedly connected to clamps 128. The clamps can then be attached, for instance, to a rolling mop cart. In a preferred embodiment, clamps 128 are designed to fit around a cylindrical bar. However, those with skill in the art will recognize that any type of clamp or attachment method can take the place of brackets 124, T-shaped projections 126 and clamps 128, for instance, hook and loop, magnets, snap joints, bolts, welding, etc.

Figure 22:
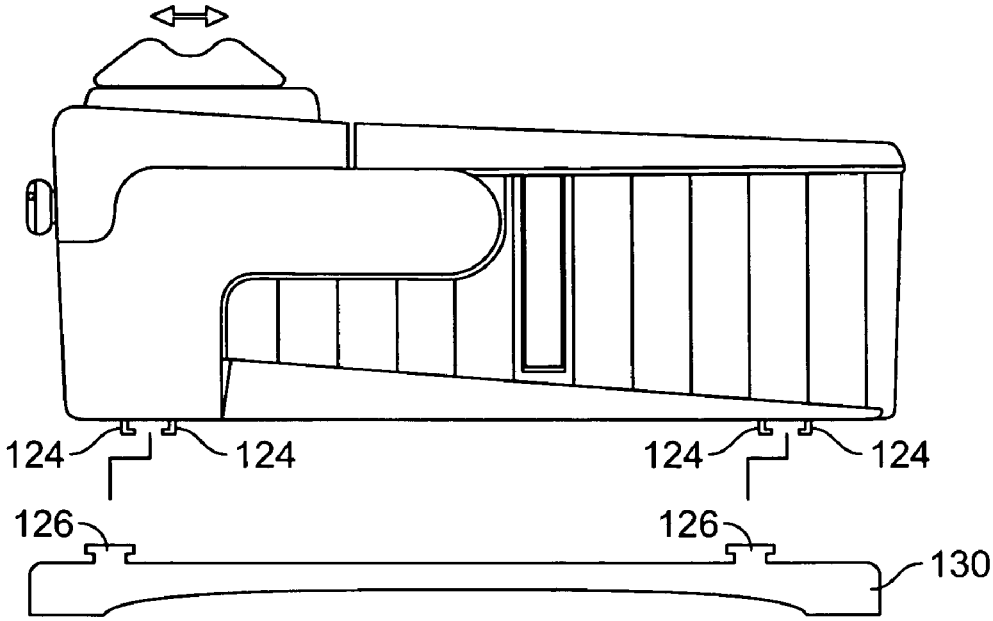
FIG. 22 is a side view of one embodiment of the present invention showing a floor mount arrangement thereon.

Another embodiment of the invention, as shown in FIG. 22, shows that instead of having the T-shaped projections connected to a clamp, they are connected to an elongated base structure 130. This embodiment can be used, for instance, when a user desires to have the mop dispenser 10 resting directly on a floor.

As those skilled in the art will readily understand, operation of one embodiment of the present invention is accomplished by a user first deciding what size mop he or she wishes to use, and selecting the appropriately sized holding pan 12. Next, the user locks the holding pan 12 into the rolling section 14 and fills the holding pan 12 with the desired amount and size of flat mops and subsequently fills the holding pan 12 with cleaning solution. When a user desires to dispense a flat mop (either from a rolling mop cart, from the floor or otherwise), the user first selects the desired method of dispensing the mops (i.e., by moving diverter 46 toward the front or rear of the roller section 14 to dispense the mop either onto the top of the holding pan or onto the floor, respectively). To dispense a mop, the user then energizes the prime mover (either through a RF transmitter, a hand or foot pedal, a crank or otherwise) and dispenses a mop. Once the mop has been dispensed, the user can then use the mop for any desired purpose. Thus, as can be seen by the above description the mop dispenser 10 of the present invention allows a user to easily dispense mops with minimal effort, without contaminating the cleaning solution with dirt, bacteria or viruses, and while conserving resources by not having to waste cleaning solution.

The foregoing description of a preferred embodiment of the invention has been presented for purposes of illustration and description, and is not intended to be exhaustive or to limit the invention to the precise form disclosed. For instance, although a preferred embodiment of the present invention is used to dispense flat mops, any object with acceptable dimensions can be dispensed in the dispenser of the present invention, such as, for instance, finishing applicators. Also, both reusable and disposable mops and other objects can be used with the practice of the present invention. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A mop dispenser comprising:

a holding pan;

at least one roller, wherein said at least one roller is positioned proximate to a stack of mops in said holding pan;

wherein said roller rotates to engage a mop and remove said mop from said pan; and wherein said dispenser includes a top portion having perforations therein and wherein said perforations allow any fluid on said top portion to flow back into the holding pan.

2. The dispenser according to claim 1, wherein said dispenser contains first and second rollers, wherein said mop passes between said first and second rollers.

3. The dispenser according to claim 1, wherein said stack of mops are biased in an upward direction.

4. The dispenser according to claim 3, wherein said stack of mops are biased upwardly by at least one resilient member.

5. The dispenser according to claim 4, wherein said resilient member is a spring.

6. The dispenser according to claim 1, further comprising a reciprocating pick-up bar proximate said stack of mops, wherein said pick-up bar urges said mop toward said roller.

7. The dispenser according to claim 1, wherein said holding pan is removably attached to said dispenser.

8. The dispenser according to claim 1, wherein said roller is driven by a prime mover.

9. The dispenser according to claim 8, wherein said prime mover comprises an electric motor.

10. The dispenser according to claim 8, wherein said prime mover is actuated using an RF transmitter and receiver.

11. The dispenser according to claim 1, wherein said roller is contained in a pivoting head section of said dispenser.

12. The dispenser according to claim 11, wherein said holding pan is removable from said dispenser when said pivoting head section is pivoted in an upward direction.

13. The dispenser according to claim 12, wherein said dispenser can accommodate multiple sizes of holding pans.

14. The dispenser according to claim 13, wherein said dispenser automatically detects the size of a holding pan when the pan is placed in the dispenser and adjusts the amount of revolutions of said roller based on the size of the holding pan.

15. The dispenser according to claim 13, wherein a user manually instructs the dispenser as to what size holding pan is being used and wherein the amount of revolutions of said roller is adjusted based on the size of the holding pan.

16. A mop dispenser comprising:

a holding pan;

at least one roller, wherein said at least one roller is positioned proximate to a stack of mops in said holding pan;

wherein said roller rotates to engage a mop and remove said mop from said pan; and a reciprocating pick-up bar proximate said stack of mops, wherein said pick-up bar urges said mop toward said roller; and wherein said pick-up bar is slidably connected to a gear connected to said roller.

17. A mop dispenser comprising:

a holding pan;

at least one roller, wherein said at least one roller is positioned proximate to a stack of mops in said holding pan;

wherein said roller rotates to engage a mop and remove said mop from said pan; and wherein said holding pan contains a liquid level window with indicia located proximate said window.

18. A mop dispenser comprising:

a holding pan;

at least one roller, wherein said at least one roller is positioned proximate to a stack of mops in said holding pan;

wherein said roller rotates to engage a mop and remove said mop from said pan; and wherein said dispenser further comprises a diverter proximate said roller, said holding pan further comprises a top cover, wherein said diverter is slidably connected to said dispenser and wherein the position of said diverter determines whether a mop will be dispensed onto a floor surface or onto said top cover.

19. The dispenser according to claim 18, wherein said top cover is perforated.

20. A mop dispenser comprising:

a holding pan;

at least one roller, wherein said at least one roller is positioned proximate to a stack of mops in said holding pan;

wherein said roller rotates to engage a mop and remove said mop from said pan;

wherein said roller is driven by a prime mover; and wherein said prime mover comprises a pedal.

* * * * *